US010118213B2

(12) United States Patent
Graff et al.

(10) Patent No.: US 10,118,213 B2
(45) Date of Patent: Nov. 6, 2018

(54) METHOD OF FORMING A SHEET STEEL WORKPIECE

(71) Applicants: THYSSENKRUPP STEEL EUROPE AG, Duisburg (DE); THYSSENKRUPP AG, Essen (DE)

(72) Inventors: Stéphane Graff, Unna (DE); David Pieronek, Dortmund (DE); Markus Zörnack, Lake Orion, MI (US)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 81 days.

(21) Appl. No.: 14/838,026

(22) Filed: Aug. 27, 2015

(65) Prior Publication Data

US 2016/0067763 A1 Mar. 10, 2016

(30) Foreign Application Priority Data

Sep. 4, 2014 (DE) ..... 10 2014 112 755

(51) Int. Cl.
*B21B 1/38* (2006.01)
*B21D 22/02* (2006.01)
(Continued)

(52) U.S. Cl.
CPC ..... *B21D 53/30* (2013.01); *B21B 1/38* (2013.01); *B21D 22/022* (2013.01); *C21D 1/06* (2013.01);
(Continued)

(58) Field of Classification Search
CPC .... B21D 53/30; B21D 22/022; B21D 35/001; B21D 35/007; B21D 39/031; B21B 1/38;
(Continued)

(56) References Cited

U.S. PATENT DOCUMENTS 3,648,353 A * 3/1972 Anderson ..... B23K 20/04 228/115
3,754,874 A * 8/1973 Anderson ..... B60R 13/04 428/636
(Continued)

FOREIGN PATENT DOCUMENTS

CN 103409613 A 11/2013
CN 103909381 A 7/2014
(Continued)

OTHER PUBLICATIONS

DE 102012100278 A1, Rotationally Symetric Component, EPO English Machine Translation; Wllfried Schneider, Mar. 28, 2017, pp. 1-4.*
(Continued)

*Primary Examiner* — Bayan Salone
(74) *Attorney, Agent, or Firm* — thyssenkrupp North America, Inc.

(57) ABSTRACT

The invention relates to a method for the forming of a workpiece, in particular a blank, composed of sheet steel, in which method the following steps are performed in succession: providing a workpiece composed of multiple steel layers which have been non-detachably connected to one another by roll-bonding and of which at least two steel layers have a different strength and/or elongation at fracture, heating the workpiece, and subjecting the workpiece to hot forming. To ensure a high strength and at the same time the easiest possible formability, the invention proposes that at least one section of the hot-formed workpiece is hardened, and that the workpiece is subsequently subjected to cold forming in the region in which the hardening has been performed. The invention also relates to a corresponding workpiece.

12 Claims, 1 Drawing Sheet

(51) Int. Cl.

| | |
|---|---|
| ***B21D 35/00*** | (2006.01) |
| ***B21D 39/03*** | (2006.01) |
| ***B21D 53/30*** | (2006.01) |
| ***C21D 1/06*** | (2006.01) |
| ***C21D 6/00*** | (2006.01) |
| ***C21D 1/673*** | (2006.01) |
| ***C21D 7/02*** | (2006.01) |

(52) U.S. Cl.
CPC ..... *C21D 1/673* (2013.01); *C21D 6/00* (2013.01); *C21D 7/02* (2013.01); *B21D 35/001* (2013.01); *B21D 35/007* (2013.01); *B21D 39/031* (2013.01); *Y10T 29/49524* (2015.01); *Y10T 29/49526* (2015.01); *Y10T 29/49529* (2015.01); *Y10T 29/49531* (2015.01)

(58) Field of Classification Search
CPC ... C21D 6/00; C21D 1/06; C21D 7/02; C21D 1/673; Y10T 29/49524; Y10T 29/49526; Y10T 29/49529; Y10T 29/49531
USPC ..... 29/894, 894.35, 894.351, 894.354; 72/363; 148/602
See application file for complete search history.

(56) References Cited

U.S. PATENT DOCUMENTS 3,790,219 A * 2/1974 Watts ..... B60B 3/08 301/64.306
5,568,745 A * 10/1996 Daudi ..... B21D 53/26 72/353.2
5,669,992 A * 9/1997 Bronsema ..... B21D 5/08 148/575
6,244,668 B1 * 6/2001 Hale, Jr. ..... B21D 53/30 301/63.101
6,450,583 B2 * 9/2002 Hale, Jr. ..... B21D 53/30 29/894.353
6,743,307 B1 * 6/2004 Engl ..... C21D 8/0273 148/333
7,998,289 B2 * 8/2011 Brodt ..... B21D 35/00 148/567
8,048,237 B2 * 11/2011 Kimura ..... B21B 3/00 148/320
8,336,208 B1 * 12/2012 Weld ..... B23P 15/00 29/527.5
8,491,063 B2 * 7/2013 Stich ..... B60B 3/044 301/63.103
8,535,813 B2 * 9/2013 Becker ..... B32B 15/011 428/683
8,646,301 B2 * 2/2014 Yokota ..... C21D 1/20 72/201
2006/0137779 A1 * 6/2006 Brodt ..... B21D 35/00 148/567
2010/0282376 A1 * 11/2010 Kimura ..... B21B 3/00 148/602
2011/0111252 A1 * 5/2011 Becker ..... B32B 15/011 428/624
2011/0227400 A1 * 9/2011 Stich ..... B60B 3/044 301/63.101
2014/0021177 A1 * 1/2014 Koch ..... B23K 26/36 219/121.69
2014/0060709 A1 * 3/2014 Tange ..... C21D 6/005 148/568
2014/0203576 A1 * 7/2014 Handing ..... B60R 19/023 293/102

FOREIGN PATENT DOCUMENTS

DE 4303884 A1 8/1994
DE 102008022709 A1 11/2009
DE 102008048389 A1 6/2010
DE 102012100278 A1 * 7/2013 ..... B21D 35/007

OTHER PUBLICATIONS

Office Action from German Patent Office dated May 13, 2015 for German priority patent application No. 102014112755.2.
English Abstract of DE 102012100278 A1.
English Abstract of DE 4303884 A1.
English abstract for CN103409613A.
English abstract for CN103909381A.

* cited by examiner

METHOD OF FORMING A SHEET STEEL WORKPIECE

CROSS-REFERENCE TO RELATED APPLICATIONS

This application claims priority to prior filed German Patent Application Serial No. DE 102014112755.2 filed Sep. 4, 2014, the entire contents of which are hereby incorporated by reference herein.

FIELD

This disclosure relates to relates to a method of forming of a workpiece, in particular a blank, composed of sheet steel.

BACKGROUND

A vehicle wheel is a safety-critical component and must therefore permanently withstand high fluctuating mechanical loads during operation. Conventional steel wheels are composed of a wheel disc, which ensures the connection to the wheel hub, and a wheel-rim band for holding a tyre, which wheel-rim band is connected in encircling fashion at the inside to the wheel disc. Wheel discs are nowadays manufactured on multistage presses with up to 11 stages. Here, use is made almost exclusively of microalloyed and dual-phase steels with a strength of 400 to 600 MPa. Aside from the fatigue strength of steel wheels, weight plays an essential role; this has an effect on material costs, non-suspended masses, rotationally moving masses and fuel consumption.

That which has been stated above self-evidently also applies to numerous other components, in particular in the chassis region of motor vehicles. The present invention therefore relates to the production of any components. Below, therefore, the production of a wheel disc is mentioned merely by way of example.

In order, nowadays, to attain further weight advantages in the case of the wheel disc, material with a relatively high yield strength and adequate vibration resistance must be used in order to ensure an adequate fatigue strength of the wheels, and furthermore, the loss of rigidity in the case of relatively small sheet-metal thickness must be compensated by way of geometrical adaptations, for example relatively thick embossments. Further geometrical adaptations are necessary for example in the region of the bolt holes for receiving the wheel bolts. With increasing strength of the steel materials (carbon steel), however, it is generally the case that the degree of formability decreases; this has already been almost fully exploited in the case of current wheel discs. Therefore, the further lightweight construction potential of cold-formed solutions appears to be limited.

In the vehicle/body construction sector, in addition to cold forming processes, use is also made, inter alia, of hot forming processes. Through the use of hot forming, the demand for high formability with simultaneously high strength of the resulting components can be satisfied. Forming methods which are performed with the involvement of a prior heat treatment of the workpiece, for example in a separate furnace, are well known from the prior art. In particular, hot forming and press hardening are known here.

The hot forming of blanks (plate-shaped workpieces) composed of higher-strength and ultra-high-strength steels for the production of a wide variety of components is performed for example by virtue of the workpiece being brought to a temperature above the austenization temperature, and forming being performed immediately thereafter in a forming tool.

It is furthermore known for hot-formed components to be press-hardened. Press-hardening is based on the principle of the workpiece, which has been previously heated to a temperature above the austenization temperature, being intensely cooled in the forming tool, for example using a cooling device in the form of cooling ducts in the die and in the punch of the forming tool. The rapid cooling causes the microstructure to be converted entirely into martensite, and to thus be fully press-hardened (full press hardening).

Also known from the prior art or composite materials which have multiple steel layers which are fixedly connected to one another. The steel layers of such multi-layer steel components or steel blanks are non-detachably connected to one another by roll-bonding (hot rolling).

DE 10 2012 100 278 A1 has disclosed a two-layer composite material in which the individual steel layers have different strengths. Proceeding from the starting material, that is to say the roll-bonded metal sheet, a rotationally symmetrical component is produced by cold forming.

DE 10 2008 048 389 A1 has disclosed a three-layer composite material, wherein the roll-bonded starting product is likewise formed by cold forming. In this case, the internal steel layer has a lower strength than the two external steel layers.

DE 10 2008 022 709 A1 has disclosed a likewise three-layer composite material, in which the individual layers may have different strengths. In this case, the forming is performed by hot forming.

SUMMARY

Disclosed herein is a method and corresponding tool for forming a workpiece, in particular a blank composed of sheet steel, including the steps of providing a workpiece composed of multiple steel layers which have been non-detachably connected to one another by roll-bonding and of which at least two steel layers have a different strength and/or elongation at fracture, heating the workpiece, and subjecting the workpiece to hot forming. Also disclosed herein is a workpiece, in particular a wheel disc for a vehicle wheel rim, manufactured by the presently disclosed methods.

BRIEF DESCRIPTION OF THE DRAWINGS

The present invention is described in detail below with reference to the attached drawing figures, wherein.

DETAILED DESCRIPTION

Figure 1:
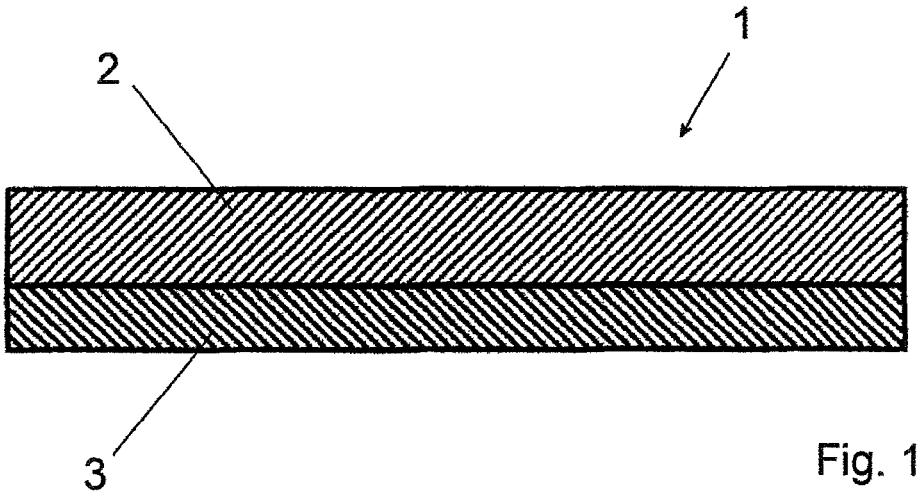
FIG. 1 is a cross-sectional view of a roll-bonded steel sheet for use with an embodiment of a method for forming a workpiece, as disclosed herein.

Various embodiments now will be described more fully hereinafter with reference to the accompanying drawings, which form a part hereof, and which show, by way of illustration, specific embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The following detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments may be readily combined without departing from the scope or spirit of the present disclosure.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

In one embodiment of the present disclosure, a method for forming a workpiece, in particular a blank composed of sheet steel, generally includes providing a workpiece composed of multiple steel layers which have been non-detachably connected to one another by roll-bonding and of which at least two steel layers (or, if only two steel layers are provided, all of the steel layers) have a different strength and/or elongation at fracture. The workpiece is then heated and subjected to hot forming. At least one section of the hot-formed workpiece is then hardened. The work piece is then subjected to cold forming in the region in which the hardening has been performed.

The steel layers of the roll-bonded starting product or of the blank run parallel to one another in the longitudinal and transverse directions. The "region in which the hardening has been performed" refers to a region (section), extending parallel to the longitudinal and transverse directions, of the workpiece (of the blank) which has been subjected to the method steps required for hardening (heating to a temperature above the austenization temperature, and subsequent rapid cooling). The "region in which the hardening has been performed" may also extend over the entire workpiece in the longitudinal and/or transverse direction(s), though need not imperatively extend over the entire thickness (direction perpendicular to the longitudinal and transverse directions), and in particular, need not extend over all of the steel layers, that is to say, in the region in which the hardening has been performed, it is by all means possible for one or more steel layers not to have been hardened, as long as it is ensured that at least one steel layer has (in sections or completely) been hardened (with the microstructure having been converted entirely into martensite).

By virtue of a composite material which has a different strength and/or elongation at fracture in some or all of the layers being subjected to hot forming, then hardening and finally cold forming in regions, it is possible for a workpiece or component to be created which firstly exhibits high strength and secondly is easily formable (on one side).

The high strength is in this case achieved through the provision of at least one steel layer of higher strength and/or lower elongation at fracture than the adjacent steel layer or (in the case of a total of more than two steel layers) than one or more of the other steel layers.

Another one of the steel layers, in particular an outer steel layer which is adjacent to the steel layer with the higher strength and/or lower elongation at fracture, has, in relation to the latter, a lower strength and/or higher elongation at fracture, and thus offers the possibility of cold forming of said layer. In this way, by massive forming, it is possible retroactively (after the hardening process) to realize special geometrical shapes on the corresponding side of the component.

For the steel layer with the high strength and/or low elongation at fracture, use may for example be made of a steel alloy, in particular a higher-strength or ultra-high-strength steel alloy, which (in the press-hardened state) has a tensile strength $R_m$ of at least 1000 MPa, preferably of at least 1200 MPa, particularly preferably of at least 1500 MPa, and/or an elongation at fracture $A_{80}$ of at most 10%, preferably of at most 7%, particularly preferably of at most 5%. An example of the latter steel alloys is a manganese-boron steel. As a steel layer with the relatively low strength and/or high elongation of fracture, use may for example be made of a steel alloy with a tensile strength $R_m$ of at most 750 MPa, preferably of at most 600 MPa, particularly preferably of at most 500 MPa, and/or an elongation at fracture $A_{80}$ of at least 12%, preferably of at least 16%, particularly preferably of at least 20%. An example of the latter steel alloys is a microalloyed steel.

According to one refinement of the method according to the invention, in the region in which the hardening has been performed, only one or only some, that is to say not all, of the steel layers is or are subjected to cold forming. In particular, in the region in which the hardening has been performed, at least one outer steel layer, preferably precisely one outer steel layer, is subjected to cold forming. This is in particular the steel layer which has a lower strength and/or higher elongation at fracture in relation to the respective other steel layer or other steel layers. Said steel layer is situated in particular on that side of the workpiece which, in the mounted state, is the far side from the component to which the hot-formed and cold-formed workpiece is fastened.

In a further refinement of the method according to the invention, the hardening of the hot-formed workpiece is performed by press-hardening. In the press-hardening process, it is the case, as already described in the introduction, that the workpiece is brought to a temperature above the austenization temperature and, in said state, is both subjected to hot forming, and also subsequently intensely cooled, in a forming tool. For the intense cooling, it is possible for the forming tool to have a cooling device in the form of cooling ducts or the like. It is basically also conceivable, in the forming tool, for parts of the workpiece to be cooled significantly more slowly, whereby the microstructure in said regions is not fully converted into martensite and thus is not fully press-hardened (partial press hardening).

In a yet further refinement of the method according to the invention, the hot-formed workpiece is fully hardened, in particular press-hardened, in the longitudinal and/or transverse direction(s). This means that at least one of the steel layers of the roll-bonded starting material is fully hardened over its entire extent, that is to say the microstructure is converted fully into martensite. Where reference is made to a hardened steel layer or a steel layer with a hardened region (section), this preferably refers to a steel layer with the relatively high strength and/or relatively low elongation at fracture.

In a yet further refinement of the method according to the invention, the provided workpiece, that is to say the roll-bonded starting material, has precisely two steel layers of different strength and/or elongation at fracture which have been non-detachably connected to one another by roll-bonding. In this case, one steel layer is composed of a steel alloy with a relatively high strength and/or relatively low elongation at fracture, whereas the adjacent steel layer is composed of a steel alloy with a relatively low strength and/or relatively high elongation at fracture. In this case, the workpiece may also be provided with further layers or coatings which are however not part of the roll-bonded starting product but which have been applied only after the roll-bonding process, for example during the course of a coating process.

In a yet further refinement of the method according to the invention, a wheel disc for a vehicle wheel rim is formed by way of said method. The wheel disc may also be equipped with holes (punched-out portions and/or bores) during the hot forming process or thereafter.

Such punched-out portions and/or bores may be subjected to further processing after the hardening of the workpiece. According to a yet further refinement of the method according to the invention, a defined cross-sectional shape of holes, in particular bolt holes, is produced as a result of the cold forming. If it is for example the intention for a wheel disc to be produced by way of the method according to the invention, it is conceivable that the shape of the bolt holes which later serve for receiving the wheel bolts is changed as a result of the cold forming which follows the method step of the hot forming and hardening. In particular, it is possible for an encircling bevel to be generated in the bolt hole as a result of the cold forming, which bevel serves, in the mounted state, for the abutment of the conical bevel of the respective wheel bolt.

In a yet further refinement of the method according to the invention, an outer steel layer of the roll-bonded workpiece (starting material), in particular the steel layer on the side which subsequently forms the abutment surface for the connection to other components, for example vehicle components, has a higher strength and/or lower elongation at fracture than the adjacent steel layer or (in the case of more than two steel layers) all other steel layers. If it is the intention for a wheel disc of a vehicle wheel rim to be produced by way of the method according to the invention, it is thus the case that the steel layer that later forms the abutment surface has the relatively high strength (at least said steel layer is also hardened), whereas the steel layer on the far side from the component can, in a simple manner, be reworked by massive forming (cold forming), in particular in the region of the bolt holes, and changed in terms of its geometric shape (said steel layer is in particular not hardened).

In addition, further disclosed herein is a workpiece or component, in particular a wheel disc for a vehicle wheel rim, produced by way of a method as disclosed above.

In FIG. 1, as a workpiece 1, a blank composed of sheet steel is illustrated in a cross section in a state before it is subjected to a further forming process (hot forming and subsequent cold forming).

The workpiece 1 in FIG. 1 is composed of two steel layers 2 and 3 which have been non-detachably connected to one another by roll-bonding and which differ in terms of their strengths and elongation at fracture. The upper steel layer 2 is composed of a steel alloy with a lower strength and a higher elongation at fracture than the other steel layer 3. The lower steel layer 3 is composed of a steel alloy with a relatively high strength and a relatively low elongation at fracture. In the present exemplary embodiment, the steel layer 2 makes up 60% of the total thickness of the plate-shaped workpiece 1, and the steel layer 3 makes up 40% of said total thickness.

Figure 2:
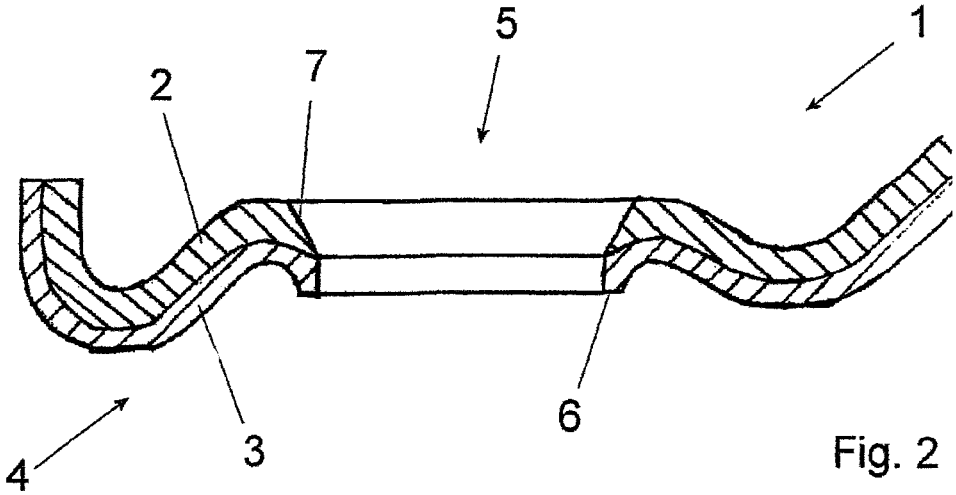
FIG. 2 is a cross-sectional view of a portion of a workpiece that has been formed by an embodiment of a method for forming a workpiece, as disclosed herein.

In order to attain the shape illustrated by way of example in FIG. 2, the workpiece 1 illustrated in FIG. 1 is initially heated to a temperature above the austenization temperature and is then subjected to hot forming and is rapidly cooled (quenched). The latter is performed in the forming tool (so-called press hardening).

The workpiece 1 thus attained is subsequently also subjected, in sections, to cold forming, specifically in the region of a hole 5 which later forms the bolt hole. During the cold forming process, the inner wall 7 of the hole 5 is subjected to forming in the region of the upper steel layer such that said inner wall corresponds to a conical bevel of a wheel bolt which serves for the later fastening to another vehicle component.

By means of the method according to the invention, it is for example possible, from a plate-shaped workpiece 1 as illustrated in FIG. 1, to produce a wheel disc 4 for a vehicle wheel rim, in which a relatively high strength is attained on the side which later forms the abutment surface 6 against the respective other vehicle component, whereas on the far side from the component, it is made possible for corresponding geometrical shapes, such as an inner wall 7, which is of conical form in sections, of a bolt hole 5, to be implemented in a simple manner by massive forming.

The component can be produced by full press hardening, and meets the requirements with regard to high operational stability and a simultaneous reduction in wall thickness.

What is claimed is:

1. A method of forming a workpiece, in particular a blank, composed of sheet steel, comprising:

providing a workpiece having multiple steel layers bonded to one another by roll-bonding, at least two of the multiple steel layers having at least one of different strengths or elongations at fracture;

heating the workpiece; and hot forming the work piece;

hardening at least one section of the hot-formed workpiece, wherein said hardening step hardens the at least one hardened section in at least one of the roll bonded steel layers of a longitudinal or transverse direction of the workpiece to provide at least a layer with a higher strength or lower elongation at fracture, wherein another one of the steel layers which is adjacent to the steel layer with the higher strength or lower elongation at fracture has, in relation to the latter, a lower strength or a higher elongation at fracture; and cold forming the hardened section of the workpiece, wherein said cold forming is performed on less than all of the steel layers in the at least one hardened section.

2. The method of claim 1, wherein said cold forming is performed on at least one outer steel layer in the hardened section.

3. The method of claim 1, wherein said hardening step is performed by press-hardening.

4. The method of claim 1, wherein said hardening step fully hardens the at least one hardened section in at least one of a longitudinal or transverse direction.

5. The method of claim 1, wherein the workpiece has only two steel layers.

6. The method of claim 1, wherein said method forms a wheel disc for a vehicle wheel rim.

7. The method of claim 1, wherein said cold forming step forms a plurality of holes through the workpiece, each hole having a pre-defined cross-sectional shape.

8. The method of claim 1, wherein an outer steel layer of the roll-bonded workpiece has a higher strength than all other steel layers.

9. The method of claim 1, wherein said cold forming is performed in the layer with the lower strength or higher elongation at fracture.

10. The method of claim 1, wherein said cold forming is a massive forming.

11. The method of claim 6, wherein punched-out portions or bores are processed after said hardening of the workpiece to provide bolt holes.

12. The method of claim 11, wherein said cold forming generates an encircling bevel in the bolt hole.

* * * * *